United States Patent [19]

Stahl

[11] 4,124,965

[45] Nov. 14, 1978

[54] METHOD FOR PRODUCTION OF CENTRIFUGAL RELEASE BAG

[75] Inventor: Robert M. Stahl, Indianapolis, Ind.

[73] Assignee: Bio-Dynamics Inc., Indianapolis, Ind.

[21] Appl. No.: 812,496

[22] Filed: Jul. 5, 1977

Related U.S. Application Data

[60] Division of Ser. No. 714,249, Aug. 13, 1976, abandoned, which is a continuation-in-part of Ser. No. 563,562, Mar. 31, 1975, abandoned.

[51] Int. Cl.[2] ..... B65B 3/02; B65B 61/02

[52] U.S. Cl. ..... 53/412; 53/452

[58] Field of Search ..... 53/14, 28, 29, 187; 206/620

[56] References Cited

U.S. PATENT DOCUMENTS

| | | | |
|---|---|---|---|
| 3,186,628 | 6/1965 | Rohde | 206/620 |
| 3,335,540 | 8/1967 | Reil et al. | 53/28 |
| 3,456,867 | 7/1969 | Repko | 206/621 |
| 3,626,143 | 12/1971 | Fry | 219/121 LM |
| 3,636,678 | 1/1972 | Maros et al. | 53/14 |
| 3,713,775 | 1/1973 | Schmitz | 233/26 X |
| 3,821,873 | 7/1974 | Benner et al. | 53/29 X |
| 3,909,582 | 9/1975 | Bowen | 206/620 |

*Primary Examiner*—Robert Louis Spruill
*Attorney, Agent, or Firm*—Woodard, Weikart, Emhardt & Naughton

[57] ABSTRACT

A method for making fluid release bags having a particular use to disperse reagents into a reaction chamber during centrifugation and as burst bags for manually dispersing reagents. The bags are made by scoring a flexible film material with a laser to form a uniform and predetermined linear depression along approximately the entire length of the film. The film is folded along the linear depression such that there are two sides of approximately equal dimensions and such that the bottom edge of the folded film is the laser scored linear depression. Portions of the two sides of the film are sealed together at predetermined intervals to form a continuous film of attached bags having one open end. A substance is injected into each bag through the open end. The open end edges are sealed together, and the bags are separated from one another into individual bags or groups of bags by suitable cutting means. These bags can then be used individually or in centrifuges and will suddenly and fully rupture at a predetermined level of pressure or centrifugal force which depends on the depth of the linear depression scored by the laser.

3 Claims, 12 Drawing Figures

METHOD FOR PRODUCTION OF CENTRIFUGAL RELEASE BAG

RELATED APPLICATIONS

This application is a division of Ser. No. 714,249, filed Aug. 13, 1976, now abandoned which is a continuation-in-part application of U.S. patent application, Ser. No. 563,562, now abandoned, filed Mar. 31, 1975 by Robert M. Stahl and entitled "BAG."

BACKGROUND OF THE INVENTION

1. Field of the Invention

This invention relates to bags having a weakened portion and more specifically to bags which suddenly and fully rupture at a predetermined force.

2. Description of the Prior Art

It is common practice for a centrifuge to be used in many of the standard assay and analysis procedures presently employed by medical laboratories, testing and research facilities. The most frequent use of a centrifuge is for the separation of the chemical components of a sample where the components have different specific gravities. However, it is also common to use a centrifuge to thoroughly mix reagents with a sample or to otherwise combine the components of a mixture. In this regard it is sometimes necessary to introduce reagents into a sample mixture while the sample is being centrifuged. This has proven very difficult to do for the obvious reason that the sample is generally rotating in a centrifuge at a high rate of speed at the very time that the reagents are to be introduced. The solution to this has been to find alternative, but generally less preferred, steps in the process for introducing the reagents when the sample is more conveniently accessible.

However, by using the release bag of this invention, it is possible to conveniently and accurately disperse a reagent or reagents into the test chamber of a cuvette and to mix reagents with a sample while the sample is being centrifuged. The centrifuged release bag has a single seam which is weaker than the remaining walls and seams and which is designed to suddenly and fully rupture within a predetermined range of centrifugal force (or within a predetermined range of revolutions per minute or r.p.m.). The idea of inserting a centrifugal release bag in a cuvette and having the bag burst during centrifugation has been previously disclosed in commonly assigned U.S. Pat. No. 3,713,775 (1973) to Schmitz. Other known burstable bags are included in U.S. Pat. No. 3,478,871 (1969) and U.S. Pat. No. 3,601,252 (1971) both to Sager. The bag of this invention is equally adaptable to bursting by means of manual pressure. While this disclosure will primarily be directed to a bag designed to release a substance during centrifugation, it should be understood that the same bags that are centrifugally burstable are likewise manually burstable. Therefore, for purposes of this application, the terms centrifugal release bag and burst bag should be considered interchangeable.

Prior attempts at making reagent bags having a single weakened seam have generally resulted in a bag which does not have the desired degree of predictability in terms of the r.p.m. at which the contents are released and additionally have generally suffered in that the process of making the bags made it difficult to prevent contamination of the reagent bag itself. One prior method of making such a bag was to place two strips of a plastic material together and to seal the strips with wax using less wax at one seam. Problems have been found in this method due to the fact that the wax was generally contaminated and due to the fact that the heat which may be developed during centrifugation creates a tendency for the seams of the bag to entirely disintegrate, thus prematurely releasing the reagents contained therein. In addition, the range of reagents that could be put into bags was not large due to the chemical reactivity between the wax and most chemical reagents. A second pair method of weakening a single portion of a reagent bag was by the use of a simple cutting instrument, such as a razorblade, to make a small cut in the bag material at the desired rupture point. This has obvious deficiencies in that it ruptures the use of a cutting blade on a structure which is generally approximately 0.003 inches thick. The cut required in something such as this is on the order of 0.0025 inches deep into the 0.003 inch structure. This has created many problems which have not been solved by the use of a manual or automatic cutting instrument or a blade cutting instrument in the making or forming of centrifugal release bags. Cutting the material with a knife blade also results in metal flakes remaining in the material and forms a score which may have capillary leaks when the material is folded to form the bag. The use, however, of a laser has been very successful in forming the linear depression necessary in forming the reagent bags of this invention. More particularly, the use of the laser allows not only a cut to be made but also the size and shape of the cut to be varied by varying the focal length of the laser beam. Additionally, modern technology allows the control of the strength of the laser beam to whatever degree is desired and hence the cut or linear depression made into the film can be controlled to the desired degree to allow bags to be manufactured having bursting points over a wide spectrum of centrifugal forces.

SUMMARY OF THE INVENTION

This invention relates to a release bag which comprises a film, which includes a first side and a second side, with the first and second sides being joined by sealing at three seams. The first and second sides have a single non-sealed common edge and a scored linear depression in that common edge. The scored linear depression is such that the common edge is of predetermined strength sufficiently weak to fail and open under the action of force creating means to permit the flow of a substance contained in the bag into, for example, a test chamber.

This invention also comprises a method for making release bags, and particularly centrifugal release bags, having one seam of predetermined strength.

It is an object of this invention to provide a centrifugal release bag which releases the contents of the bag at a predetermined centrifugal force and a method for making said bag.

It is a further object of this invention to provided a release bag using methods and materials which minimize contamination problems.

It is still a further object of this invention to provide a method for producing release bags in a continuous fashion.

It is an additional object of this invention to provide a method for producing release bags which do not depend on a cutting blade for the scoring step.

These and other objects of this invention will become apparent from the following detailed description of the preferred embodiment.

DETAILED DESCRIPTION OF THE PREFERRED EMBODIMENT

Figure 1:
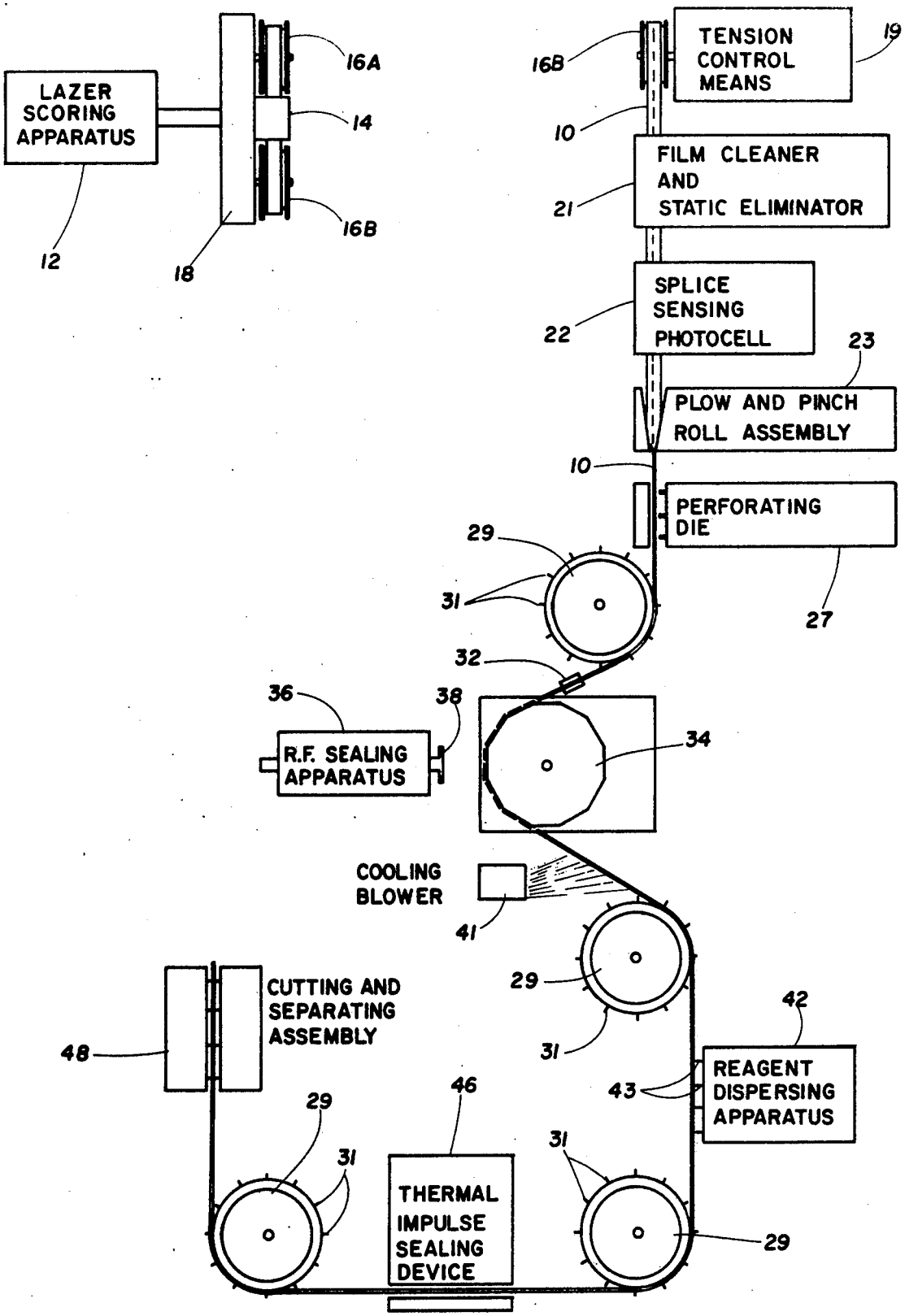
FIG. 1 is a schematic showing the progression of steps in the method of this invention.
Figure 2:
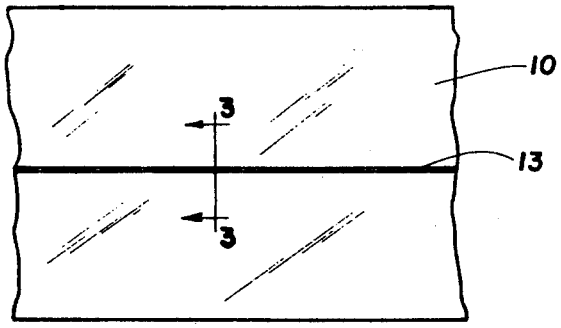
FIG. 2 is a top view of the film material after being scored by the laser.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The preferred film material 10 used in making the centrifugal release bags 11 of this invention is sold under the trademark ACLAR and is a flexible thermoplastic film made of chlorinated fluorinated resins. Other such films can be used equally well. The chlorinated fluorinated resins are ideally suited for films of this type as the chlorine gives the film 10 thermal and chemical stability while the fluorine contributes to the clarity and heat sealing ability of the film. The film 10 is 0.0032 inches in thickness, although this may be varied depending on the use for which the bag is intended, such as the centrifugal force to be applied to the bag, and also the chemical to be contained by the bag. A variable which affects the desired thickness of the film 10 used to make the bag is the size of the bag itself and hence the absolute weight of the material contained by the bag. Although not critical, factors which have been found desirable and which are characteristic of preferred film materials are: low dialectric constant and dissipation factor, high dialectric strength, chemical stability, ultraviolet resistance, dimensional stability, transparency over a wide spectrum, non-stick qualities, low permeability to water vapor and other gases, and non-flammability. For purposes of a practice of the method of this invention it has also been found desirable that the film 10 be heat sealable, printable, and sterilized. While all of these characteristics are present in the ACLAR film preferably used in the method of this invention, all or some of these characteristics may be omitted in other similar films which may be suitable for specific bags, specific uses, and specific reagents. The film material is normally purchased in lengths of from about 3200 feet to about 3600 feet, a thickness of approximately 0.0032 inches, and a width of 2 inches.

Figure 3:
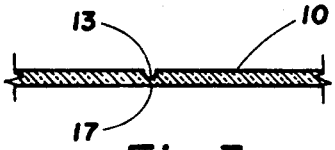
FIG. 3 is a side view partially in section taken along line 3—3 of FIG. 2 and viewed in the direction of the arrows showing the linear depression.

A laser 12 is used to score a linear depression 13 along substantially the entire length of the film 10. The laser 12 beam may be developed from any of a variety of commerically available laser apparati. A carbon dioxide laser 12 is the preferred type of laser 12, although others are similarly useful. As is well known in the laser art, the cutting strength of the laser 12 can be varied by varying the electrical wattage supplied to the laser instrument. In the same fashion, the shape of the cut made by the laser beam may be varied by changing the focal length of the laser beam. The fact that the linear depression 13 has a smooth U-shape in cross section when made by a laser 12 as shown by FIG. 3, as opposed to being jagged or V-shaped as would be formed by a blade cutting instrument, is advantageous in that the U-shaped depression prevents premature bursting of the bag 11. The preferred focal length for ACLAR is 2.5 inches. A particularly preferred laser apparatus is the Photon Sources carbon dioxide laser manufactured by Photon Sources in Livonia, Michigan. The laser is arranged such that the focal point 14 of the laser beam is on the film material as it travels between two large reels 16 attached to the laser apparatus 12. The film material 10 is fed from reel 16A to 16B at a constant rate. During the transfer from reel 16A to a reel 16B the laser 12 is used to score a linear depression 13 in approximately the middle of the film material 10. Whereas the original thickness of the film material 10 is approximately 0.0032 inches, the remaining thickness of the film material at the linear depression 13 is approximately 0.0005 inches. The remaining portion of the film at the linear depression will hereinafter be referred to as the residual 17 and the thickness of that portion will be referred to as the residual 17 thickness. The residual 17 thickness can be varied depending upon the particular centrifugal force desired to be used to burst the centrifugal release bags 11. The linear depression 13 itself is U-shaped as shown in FIG. 3 and does not have any sharp points of penetration as discussed previously. The portion of the film material which is vaporized by the application of the laser beam in forming the linear depression 13 is sucked up by vacuum apparatus to prevent any potential gasification of personnel by poisonous elements which may be contained in the gaseous waste from the laser scoring operation. The entire roll of film material is scored in a like manner.

It has been found that the film material 10 varies slightly in thickness at points along its length. While for normal uses these thickness variations would be insignificant, when centrifugal release bags 11 are being made the required scoring of the film 10 material must be precise within definite limits which do not allow for variations in film thickness. Therefore, it is desirable in most instances to have an apparatus coordinating the strength of the laser beam, as is controlled by the electrical wattage to the laser producing apparatus 12, and the thickness of the film 10 material being fed under the laser beam. This can be accomplished by any of a variety of well-known measuring apparatus 18 which can be connected to the laser electrical supply in a manner such that the residual 17 thickness is constant. A particularly preferred apparatus is the Metri-Gap Capacitance Film Checker, Model No. 300-4 manufactured by the Lion Precision Company.

Upon completion of the scoring operation, the scored roll of film material is removed from the laser apparatus and engaged in the bag 11 forming apparatus. In aligning the scored film on the reels used in both the laser apparatus and the bag forming apparatus, it has been found desirable that the film be placed such that when the film is folded in the bag making apparatus the side of the film having the linear depression 13 is formed into the outside of the bag 11. While this is not critical, it has been found preferable. Reel 16B having the scored film 10 wound thereon is transferred from the laser apparatus 12 to the tension control means 19 of the bag forming apparatus.

The scored film 10 is first fed through a film cleaner and static eleminator apparatus 21. The apparatus which has been found most suitable for performing this operation is a Simco Midget Film Cleaner and Simco Antistatic Handbrush manufactured by the Simco Company, Inc. of Landsdale, Pennsylvania. The film cleaning and static eliminating apparatus 21 comprises a pair of brushes and a pair of shockless static bars in a metal housing. This apparatus simultaneously cleans and neutralizes the roll of scored film 10. The scored film 10 is passed between the brushes. The static bar preceding the brushes permits dust and foreign matter to be easily removed, and the static bar following the brushes assures a completely neutral material to which dust will not reattract. Optionally, a dust collection system comprising a centrifugal blower with a dust collection bag and flexible connecting air hose may be connected to this apparatus if significant amounts of dust and other foreign matter are being collected. However, this is generally not necessary due to the sterile nature of the film 10.

The scored film 10 is fed from the film cleaning and static eliminating apparatus through a splice sensing photocell 22. Since the film material 10 is generally available in only limited lengths, it has been found preferable for the lengths of film material to be joined together before being placed on the large 6 to 8 inch reels 16A and 16B which are commonly used for the method of this invention. Therefore, when the splices come to the splice sensing photocell 22, the portion of the film 10 containing the splicing material is caused to bypass the remaining portion of the process or the entire bag forming process is stopped while the portion of the film 10 containing the splicing material is removed. The splicing material is not suitable for the formation of the bags 11 of this invention and therefore must be removed. However, this step may be conveniently eliminated if reels of smaller size are used or if longer lengths of the film material become available.

Figure 4:
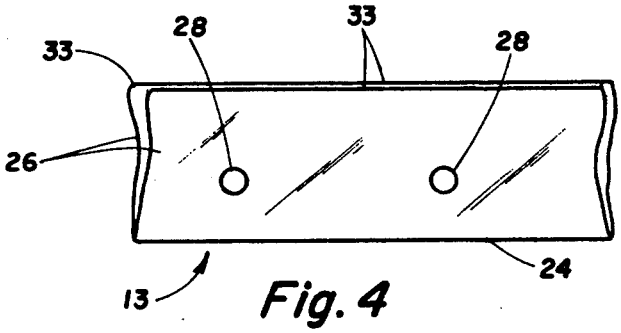
FIG. 4 is a side view of the film material as it appears when folded and after indexing holes have been punched.

The scored film 10 is next fed into a plow and pinch roll assembly 23. The plow and pinch roll assembly 23 folds the scored film approximately in half as shown in FIG. 4 using the scored linear depression 13 as the bottommmost edge 24 and as the point of folding. The sides 26 of the folded film 10 are folded upwardly and pressed together leaving the linear depression as the bottommost edge 24 of the film 10.

The folded film 10 next goes through a perforating die 27. Indexing holes 28 are punched in the folded film 10 at $1\frac{3}{8}$ inch intervals in order to allow the proper indexing of the bags 11. In the preferred embodiment of this invention, these indexing holes 28 allow the film to be fed through the bag forming apparatus by a series of driven pinwheels 29 having lugs 31 which engage the indexing holes 28.

Figure 5:
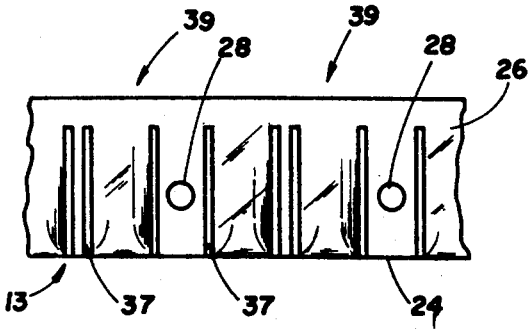
FIG. 5 is a side view similar to FIG. 4 showing the folded film as it appears after sides have been sealed to form bags.

The preferred perforating die 27 is powered by an air compressor such as the Speedaire Air Compressor manufactured by the Dayton Electric Manufacturing Company of Chicago, having a horsepower rating of approximately one. The perforated, folded film 10 is then fed onto a first pinwheel 29 at which time a series of lugs 31 continually engage the indexing holes 28 in the folded film 10 and force the travel of the film through the remaining portion of the bag forming apparatus. A separating member 32 separates the upper edges 33 of the folded film 10, while at the same time hot air is blown into the space between the upper edges to belly-out or separate the two side portions 26 of the folded film 10. The film 10 then engages a turntable 34 having twelve dies, each die having the appropriate mold to form four bags 11. A radio frequency (hereinafter RF) sealing device 36 is then used to form side seals 37 in the film 10 at predetermined intervals. A ram 38 which is heated by the RF sealing device 36 to temperatures from about 155° F. to 160° F. mates with the die of the turntable 34 with the perforated folded film 10 pressed inbetween. The RF sealing ram 38 causes the side seals 37 of the bags 11 to be formed at the desired intervals. At the same time that the RF sealing operation is taking place a vacuum is drawn on the now individual bags 11 to belly the bags. This prevents a sealing or a separation of the entire bag structure. Immediately after the side seals 37 of the bags 11 have been formed, which results in a continuous film of bag-like structures, as shown by FIG. 5, having two RF sealed seams 37, one common edge 24 having a laser scored linear depression 13 and one open end 39, the film 10 is removed from the RF sealing device 36 and a blast of air from a cooling blower 41 is applied to cool the bags 11 preventing any structual breakdown of the film 10 material.

A second pinwheel 29 now engages the bags 11 in the same manner as the first pinwheel 29 with the lugs 31 of the pinwheel 29 engaging the indexing holes 28 of the continuous film 10 of bags 11. The continuous film 10 of bags 11 is next fed into a reagent dispensing device 42. In this area the bags 11 are filled individually or in multiple units by inserting a needle-like device 43 into the unsealed open end 39 of the bags 11 and injecting a predetermined amount of reagent 44 into the bags 11. Suitable apparatus for such dispensing operation is the Automatic Pipetee (High-Speed) by Micrometic Systems, Incorporated.

Figure 6:
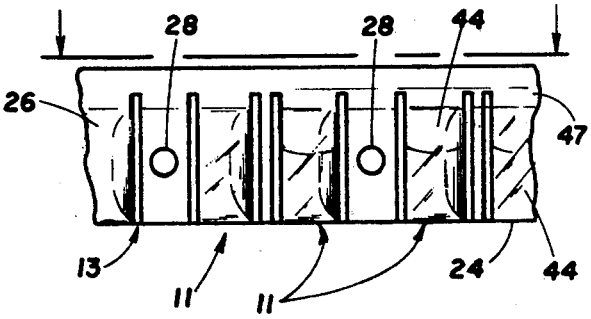
FIG. 6 is a side view similar to FIG. 5 showing the filled and sealed bags as they appear as a continuous film of attached bags.
Figure 7:
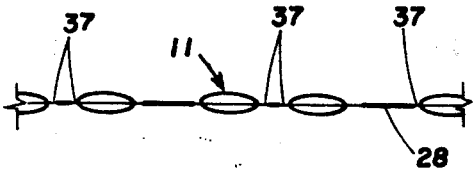
FIG. 7 is a top view of the filled and sealed bags shown in FIG. 6 taken along line 7—7 and viewed in the direction of the arrows.

The now filled bags 11 are then transferred to a thermal impulse sealing device 46. In this area the film of bags is sealed at the top 47 by thermal impulse. The top sealing 47 is done by heat which is varied according to the electrical wattage supplied to the thermal impulse apparatus 46. From about 6 watts to about 7 watts have been found to be desirable wattage ratings. The thermal impulse heating and sealing step results in a continuous length of bags 11 as shown more particularly by FIG. 6, which have three sealed seams and one common edge 24 and which are filled with a reagent 44. The bags 11 are then quickly cooled by compressed air to prevent sticking together of the top edges 33 and are then engaged by a fourth pinwheel 29 identical to the first, second and third pinwheels 29 as shown more particularly in FIG. 1.

Figure 8:
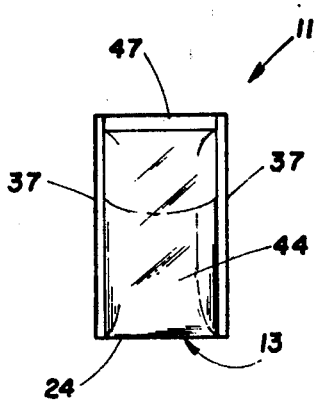
FIG. 8 is a plan view of an individual centrifugal release bag.

The bags are cut or separated from one another by any of a variety of suitable cutting devices 48 and may even be separated manually. The bags may be cut into individual bags 11 as shown in FIG. 8, or into bags of two, four or whatever size subgroup is desired. The bags are stored or dispensed to the desired packing or centrifuging locations.

A number of reagents 44 can be used and dispersed by the bags 11 of this invention. However, the fact that a variety of reagents 44 and other substances are to be contained by the bags 11 leads to a problem of identification of the bags 11. While a variety of identification methods have been used the most effective has been found to be a system whereby the side seals 37 of the bags 11 are perforated with holes of varying sizes, the holes being coded according to a binary code to identify the particular reagent 44 contained by the bag 11. Alternate methods of identifying the reagents 44 would be by simply printing the film 10 material with the reagent 44 to be incorporated into the bags 11, or potentially a color coding process whereby the film 10 material is stained to various colors for various reagents 44.

Figure 9:
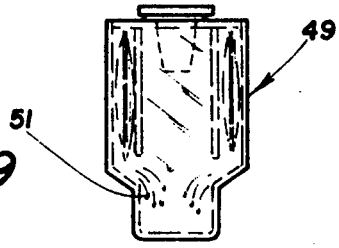
FIG. 9 is a plan view of a cuvette containing two of the centrifugal release bags of this invention at the moment when the bags burst during centrifugation.

The bag of this invention is designed to be used in any of a variety of tests and analysis apparati. More particularly, the bags can be placed in cuvettes 49 containing, for example, blood serum samples as shown more particularly by FIG. 9. After the cuvette 49 has been placed in a centrifuge the bag 11 containing the reagent 44 will burst at a precise centrifugal force thus resulting in the mixture of the sample and the reagent 44 at the desired point in time during centrifugation. In bags 11 such as are preferably produced by the process of this invention, wherein the residual 17 thickness is approximately 0.0006 inches, the bursting point has been approximately ten thousand r.p.m. reached in 5 seconds. The bags of this invention are especially useful for medical and other assay type testing purposes due to the nature of the rupturing of the bags. This not only insures that all of the reagent 44 will rupture and go into the test chamber 51 but it also insures that there will be a time lapse between an initial rupture and a complete rupture. These are both advantages which are highly desirable in this type of testing apparatus. As discussed previously, these bags may be used individually or in combination in cuvettes 49 or other holding apparatus. By varying the residual 17 thickness of the bags 11 may be made to burst at various centrifugal forces. Therefore, if a test requires two reagents 44 and it is desirable to mix one reagent 44 first and a second reagent 44 second the first bag 11 containing the first reagent 44 can be made having a residual 17 thickness thinner than the second bag 11 and therefore will burst at a lower centrifugal force. Another advantage enjoyed by the bags of this invention is the fact that the weakened seam 24 in the bags 11 is at the lowermost point in the bags. Therefore, when the bag ruptures it ruptures at a point allowing complete dispersal of all of the reagent 44 contained by the bag 11. This is opposed to other attempts at making centrifugal release bags wherein the weakened portion was other than the bottom portion. While these bags perhaps could be made to burst within a range of centrifugal forces, the fact that the bursting point was not the lowermost point in the bags would not insure that some of the reagent would not be trapped in the bag 11. This is not a problem with the centrifugal release bag 11 of this invention.

Figure 10:
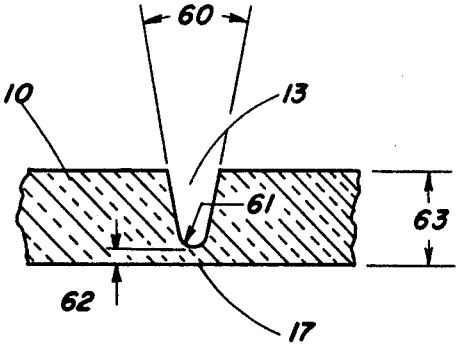
FIG. 10 is a side, cross-sectional view of the scored material.
Figure 11:
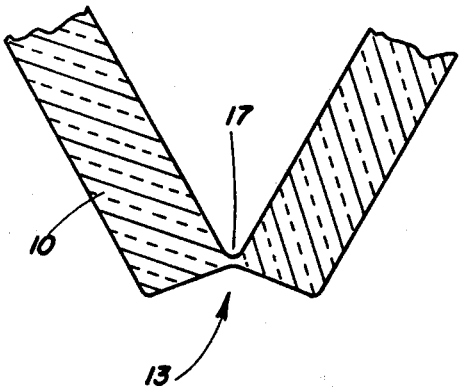
FIG. 11 is a side, cross-sectional view of the scored material showing the material partially folded in preparation for sealing.
Figure 12:
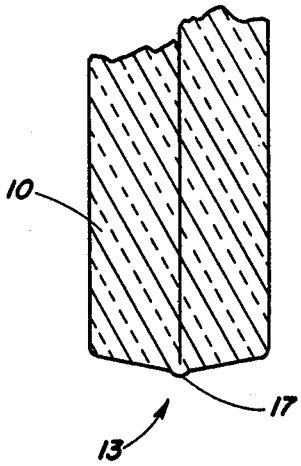
FIG. 12 is a side, cross-sectional view of the scored material folded upon itself along the score line.

Referring now to FIGS. 10–12, there are shown further details regarding the lower score and folding of the film material. The laser score depression 13 preferably has walls angled outwardly at an angle 60 of less than about 60°. Angle 60 is most preferably less than about 20°. This angle 60 has been found to be important when the film material 10 is folded along score line 13 in preparation to sealing. As angle 60 is increased, there is progressively less material at the bottom of the bag adjacent residual 17 for the sealing to act upon. Sealing is accomplished by first moving the material against itself, as shown in FIG. 12, and it is advantageous to have a maximum amount of material at the bottom for permitting the walls to be pressed together. Angle 60 being too great will therefore lead to inadequate sealing of the bottom of the bag and leaks at the bottom corners may develop.

Although a knife cut provides about the best profile for the sides of the score 13, other disadvantages such as short life of the blade and cut propagation make use of a knife cut impracticable. The laser cut is further advantageous because a curved bottom 61 is obtained which serves to prevent the score from propagating when the film material 10 is folded. Propagation of the cut results when a knife cut is used, and capillary leaks through the score then develop. The laser also serves to cauterize the film material 10, thus affecting the material itself so as to resist cut propagation.

The precision of the thickness 62 of residual 17 is also important, particularly when the bag is required to release its contents during centrifugation. Thickness 62 must be held within close tolerances for two reasons. First, the thickness 62 will determine the force or speed of the centrifuge at which the bag will burst. It is generally desirable in application that the bag burst at between 7000 and 10000 RPM. In other terms, the bag preferably will burst under the application of a compressive force of about 40 pounds. The thickness 62 has been found to preferably be about 0.0006 inches. It is desirable to hold this thickness to a variance of not greater than about 0.0001 inches. It will be appreciated that such a close tolerance is difficult or impossible to obtain with continuous, mechanical cutting operations. Wear of the cutting tool, friction acting to make the film movement irregular, and time lapse of mechanical controls are among the factors which reduce the precision of mechanical scoring. These problems are compounded by the variation in thickness 63 of the film material 10 being scored. Use of a laser, however, permits quick and accurate adjustment of the score to obtain a precise residual 17.

A second reason for maintaining a close tolerance on the thickness 62 is to insure that the bag will break along the full length of the score line. If thickness 62 varies too greatly, the bag will burst along only a portion of the score line. This may result in only a portion of the bag contents being dispensed. Further, the portion of the bag contents dispensed may be discharged over a sufficient period of time as to affect the accuracy of the results produced.

The use of a laser in producing the score line provides several advantages over the the customary knife-cutting techniques. Cutting blades have a relatively short tool life and provide an irregular cut profile. The laser produces a score having a smooth curve at the bottom and further acts to cauterize the film material, both reducing the tendency for the score to propagate through the film. The laser can produce the cut more quickly than a knife, and does not result in contamination of the film with oil or metal flakes. The location or track of the laser cut is not affected by properties of the film such as the grain of the film. The laser also does not affect the movement of the film material, whereas friction between a knife blade and the progressing film can lead to bunching up of the material behind the knife, resulting in further irregularities in the cut.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A method for making centrifugal release bags having one seam of predetermined strength sufficiently weak to fail and open under the action of centrifuging means to permit the flow of the substance contained in said bags into a test chamber comprising the steps of:

(a) obtaining a length of flexible film material;

(b) laser scoring said flexible film material to form a U-shaped linear depression for substantially the entire length of said flexible film material, said scoring reducing the thickness of said flexible film material by more than about 50% at said linear depression and to a uniform residual thickness to fail at a predetermined centrifugal speed;

(c) folding said flexible film material along said linear depression such that a structure having two opposed sides and a bottom edge is formed;

(d) sealing portions of said opposed sides at predetermined intervals to form bags having one open end;

(e) injecting a substance into said bag through said open end;

(f) sealing said open end after said substance has been injected; and (g) dividing the series of bags into subgroups by suitable cutting means.

2. The method of claim 1 wherein said flexible film is made using a fluorinated-chlorinated resin.

3. The method of claim 1 in which said scoring comprises vaporizing a portion of said flexible film material.

* * * * *